US005299336A

United States Patent [19]

Marteeny

[11] Patent Number: 5,299,336

[45] Date of Patent: Apr. 5, 1994

[54] PORTABLE DIAPER CHANGING STATION AND METHOD FOR USE THEREOF

[76] Inventor: Jean Marteeny, R.D. #3, Box 325, Somerset, Pa. 15501

[21] Appl. No.: 104,812

[22] Filed: Aug. 10, 1993

Related U.S. Application Data

[63] Continuation of Ser. No. 983,395, Nov. 30, 1992, abandoned.

[51] Int. Cl.[5] ..... A47C 27/08

[52] U.S. Cl. ..... 5/655; 5/424; 4/659

[58] Field of Search ..... 5/603, 655, 424, 490, 5/484, 417, 420; 4/580–583, 572.1, 575.1, 586, 659

[56] References Cited

U.S. PATENT DOCUMENTS

| | | | |
|---|---|---|---|
| 4,123,809 | 11/1978 | Pugh | 4/572.1 |
| 4,466,146 | 8/1984 | Regan | 4/572.1 |
| 4,630,323 | 12/1986 | Sage | 4/580 |
| 4,712,258 | 12/1987 | Eves | 5/655 |
| 4,886,150 | 12/1989 | Fitzsimmons | 5/420 |
| 4,935,973 | 6/1990 | Behrman | 5/655 |
| 5,035,013 | 7/1991 | Bloom | 5/424 |
| 5,165,130 | 11/1992 | Wendling | 5/424 |

FOREIGN PATENT DOCUMENTS

| | | | |
|---|---|---|---|
| 3134256 | 3/1983 | Fed. Rep. of Germany | 4/580 |
| 943965 | 12/1963 | United Kingdom | 5/420 |

*Primary Examiner*—Flemming Saether
*Attorney, Agent, or Firm*—Kirkpatrick & Lockhart

[57] ABSTRACT

A portable diaper changing station is disclosed for enabling changing of a baby's diaper on a surface having a protruding portion. The station includes a nonbendable rigid member having a handle portion formed therein and having an upper surface, a cushioning pad, and a nonporous wipable case attached to the upper surface, wherein the case defines an enclosure having at least one opening for receiving the cushioning pad within the enclosure. The station further includes a first foldable flap member releasably secured to one edge of the rigid member, which first flap member has pockets formed therein, a second, foldable cushioned flap member releasably secured to an opposite edge of the rigid member for cushioning the protruding portion of the surface, and connecting means attached to the rigid member for releasably connecting the rigid member to the protruding portion of the surface. A method of changing a baby's diaper using the station is also disclosed.

18 Claims, 3 Drawing Sheets

PORTABLE DIAPER CHANGING STATION AND METHOD FOR USE THEREOF

This is a continuation of copending application Ser. No. 07/983,395 filed on Nov. 30, 1992 now abandoned.

BACKGROUND OF THE INVENTION

1. Field of the Invention

The present invention relates to devices useful for supporting a baby. More particularly, the present invention relates to portable diaper changing stations and methods of their use.

2. Description of the Invention's Background

Changing a baby's diaper in a two-story house presents problems. A traditional layette, i.e., the items needed by parents for the care of a newborn baby, always includes a changing table or padded changing surface. However, permanent diaper changing tables are generally kept in an upstairs bedroom or nursery because they are relatively large pieces of furniture, and will not fit in a smaller downstairs half bathroom or powder room. Especially when a baby is younger and requires numerous changes a day, carrying the baby upstairs for each change can be exhausting. This is especially true when the one doing the changing is a mother who has recently had a caesarean section, since climbing stairs many times following abdominal surgery is very difficult and not generally advisable. Older children usually require fewer changes but weigh more. Carrying them up and down the stairs is also inconvenient and tiring.

In the typical ground floor of a two-story house, it is possible to change a baby on a kitchen counter, a dining room table, a sofa, or the floor. However, changing a diaper on a sofa or floor risks soiling the fabric or the carpet, and changing a diaper in a kitchen or on a dining room table is both unappetizing and unsanitary. It would be desirable to change a baby's diaper in a bathroom so that the changer can quickly wash his or her hands afterward, but a bathroom, especially a half bathroom, generally has only irregular surfaces on which it is difficult if not impossible to change a diaper.

There is thus a need for a device which will enable changing of a baby's diaper on an irregular surface, which device is lightweight and may easily be stored out of the way in a small room such as a half bathroom. Such a device would be even more useful it were portable and provided space to carry accessories which are needed to change a baby's diaper.

A device for supporting a baby over a drawer space is known in the prior art. Specifically, U.S. Pat. No. 3,659,297 granted to Schutz discloses in FIGS. 1–5 a baby dressing table pad replacement which includes a first part having a foam cushion which overlies a bottom stiffener board and which is surrounded by a covering, and a second part hingedly connected to the first part, which second part also includes a foam cushion and straps to secure the first part to a table. The Schutz device has the disadvantage, however, that it is specifically designed for use with a particular type of baby dressing table having an interslidable part which includes drawer spaces. The pad replacement itself thus has no provisions for the carrying of accessories needed during the changing of a baby's diaper, nor any provisions for enabling easy carrying of the pad replacement.

A changing table, termed "Bathe & Change," is known which can be mounted over a bathtub. This table includes both a bath and a changing table which are mounted to what is apparently a wire frame which rests upon the edges of a bathtub. Since the table is apparently intended to be semi-permanent, it does not include means for enabling easy carrying of the table.

Wall-mounted changing tables of the type typically seen in public rest rooms are also known in the prior art. Such a wall mounted unit includes a rigid generally rectangular molded changing surface which has a handle formed therein and which is hingedly connected to a wall unit. A depression is formed in the changing surface for supporting a baby, and a strap is mounted on the changing surface for securing the baby in the depression. Such a unit has the disadvantage that it is mounted to a wall, and thus is not portable nor useful for supporting a baby on an irregular surface. In addition, such a unit has no provision for carrying accessories needed during the changing of a baby's diaper.

Other portable devices are known in the prior art which are generally directed toward supporting an infant. For example, U.S. Pat. No. 5,103,514 granted to Leach discloses a utility pad for infants which includes a flexible, rectangular fabric tube filled with a resilient material, and a flat sheet detachably secured across the bottom of the tube to form a sleeping surface for the infant. The tube can be folded into a U-shape and retained there by engaging elements on the tube to allow carrying of the pad. U.S. Pat. No. 2,626,407 granted to Kurry discloses a folding infant's crib which includes a pair of U-shaped rims formed of flexible covers having a soft filler, a pair of U-shaped cardboard bottoms below the U-shaped rims, and a rubber sheet removably placed in the oval-shaped recess between the rims. The crib can be folded in half and placed in a flexible case for carrying. Also, a product by BabyBjorn, termed the Travel Changing Bag, includes a soft changing surface to which pockets are attached, which surface can be folded up and carried like a handbag. The above devices have the problem, however, that their bottom surfaces are flexible and thus ill-suited for supporting an infant above an irregular surface, such as a sink. In addition, the devices of the Leach and Kurry patents fail to present an easy way to transport accessories which are needed in the care of an infant, and they thus necessitate the carrying of diaper bags and the like along with the devices, therefore making them less convenient.

Other types of devices are known which are adapted to act as portable supports and which include pockets for storage. For example, U.S. Pat. No. 4,750,402 granted to Markey discloses a collapsible table cover assembly for use in the handbell performing arts, which also serves as a carrying case for implements used in playing handbells. The cover includes internal padding, a rear pocket portion which is foldable over the padding, and a vertical apron which is releasably attached to the padding. A handle is permanently attached to the back of the padding. Also, U.S. Pat. No. 4,863,003 to Carter discloses a combination seat cushion tote bag, which includes a padded seat cushion to which is foldably attached a pocket portion and another portion. The two portions fold over the cushion to releasably attach at two corresponding Velcro fasteners. Portable devices such as disclosed in the Markey and Carter patents, however, have the problem that they are highly flexible and thus ill-suited for supporting on an irregular surface, especially a surface have a cavity therein. Such devices are thus ill-suited for safely supporting a baby on an irregular surface during an activity such as diaper changing.

In view of the above, it is an object of the present invention to provide an improved diaper changing station which is readily capable of supporting a baby on an uneven or irregular surface.

It is another object of the present invention to provide an improved method of changing a baby's diaper using a portable changing station.

A further object of the present invention is to provide a diaper changing station which is portable.

A further object of the present invention is to provide a method of safely and comfortably changing a baby's diaper using a portable changing station mounted on a surface having a cavity formed therein and a protruding portion formed thereon.

It is a further object of the present invention to provide a diaper changing station which is adapted to easily carry accessories which are necessary to change a baby's diaper.

A further object of the present invention is to provide a diaper changing station which is relatively easy to carry.

SUMMARY OF THE INVENTION

The above objects as well as other objects not specifically enumerated are accomplished by a portable diaper changing station in accordance with the present invention. The portable diaper changing station of the present invention includes a nonbendable rigid member having a handle portion formed therein and having an upper surface, a cushioning pad, and a nonporous wipable case attached to the upper surface, wherein the case defines an enclosure having at least one opening for receiving the cushioning pad within the enclosure. The station further includes a first foldable flap member releasably secured to one edge of the rigid member, which first flap member has pockets formed therein, a second, foldable cushioned flap member releasably secured to an opposite edge of the rigid member for cushioning a protruding portion of a surface, and connecting means attached to the rigid member for releasably connecting the rigid member to the protruding portion of the surface.

The objects of the invention are also accomplished by a method of changing a baby's diaper using a portable changing station mounted on a surface having a cavity formed therein and a protruding portion formed thereon. The method includes the steps of placing the portable baby diaper changing station on the surface such that a baby support means of the station overlies the cavity to support a baby above the cavity, wherein the support means includes a cushion overlying a rigid member, securing a releasable securing strap which is attached to the rigid member around the protruding portion to secure the portable baby diaper changing station to the protruding portion, and extending a foldable cushioning means which is releasably secured to the support means over the protruding portion to protect the baby from accidental contact with the protruding portion. The method further includes the steps of extending a foldable accessory holding means which is releasably connected to the support means away from the support means such that accessories for changing a baby's diaper which are held in the holding means are accessible, placing the baby on the support means such that the support means supports and cushions the baby on the surface, changing the baby's diaper, and removing the baby from the support means.

BRIEF DESCRIPTION OF THE DRAWINGS

The preferred embodiment of the present invention will be described in greater detail with reference to the accompanying drawings, wherein like members bear like reference numerals and wherein.

DETAILED DESCRIPTION OF THE PREFERRED EMBODIMENT

Figure 1:
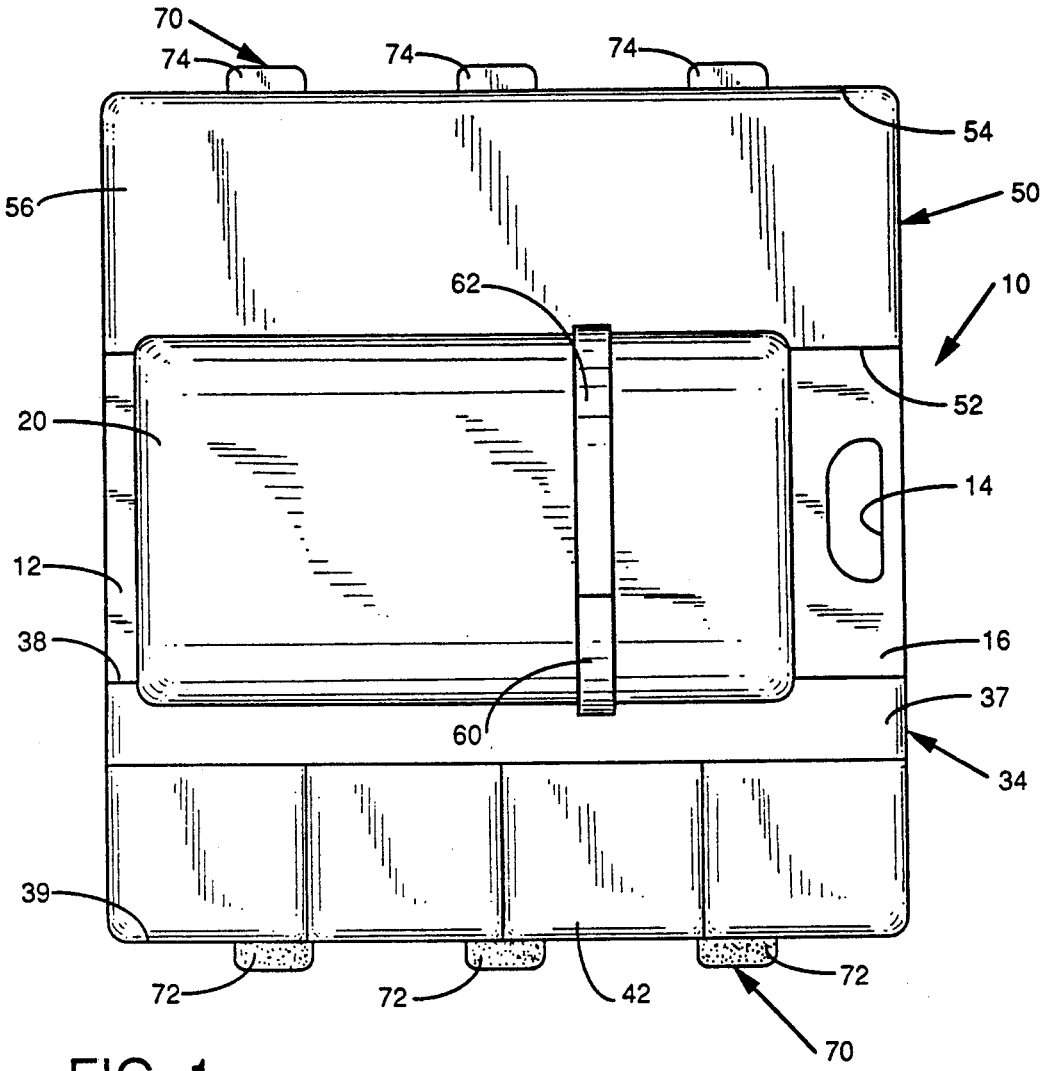
FIG. 1 is a top view of a portable diaper changing station of the present invention.
Figure 2:
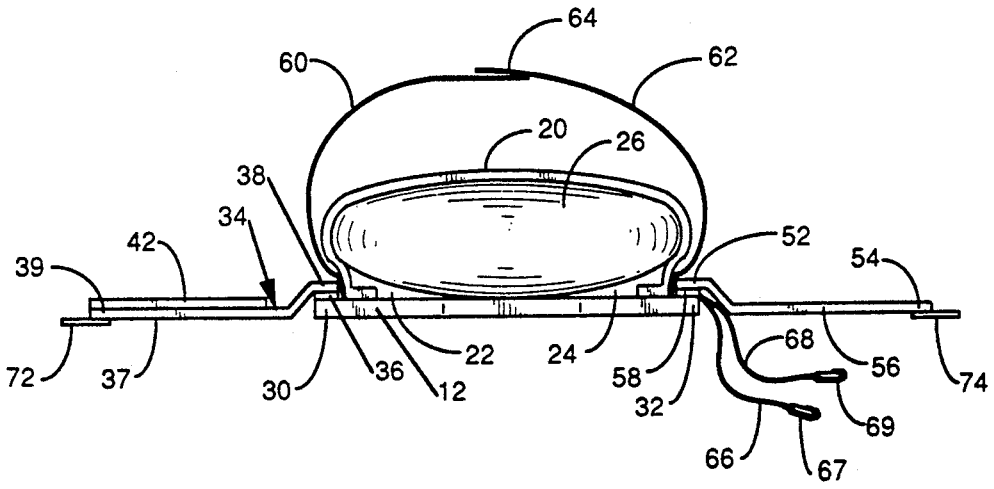
FIG. 2 is an end view of the portable diaper changing station of FIG. 1, with flap members of the station extended away from the station.
Figure 3:
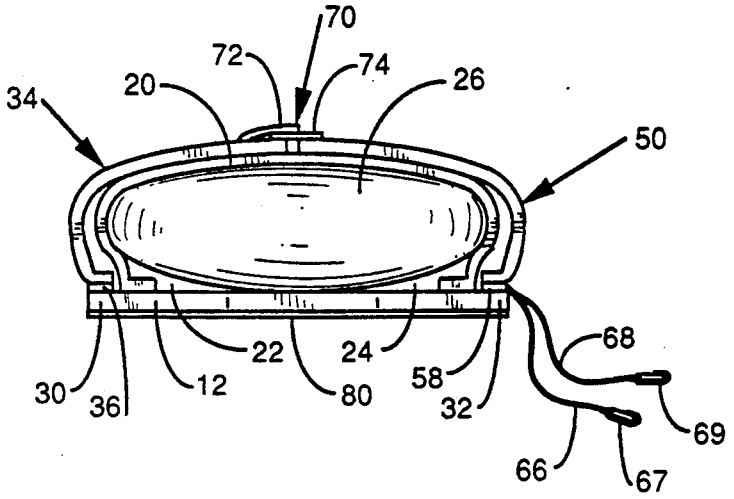
FIG. 3 is an end view of the portable diaper changing station of FIG. 1 with the flap members folded into positions overlying a support means of the station.

With reference to FIGS. 1-5, a portable diaper changing station 10 in accordance with an embodiment of the present invention includes a rectangular nonbendable rigid member 12 having a handle 14 formed therein and having an upper surface 16. The rigid member 12 has rounded corners thereon, and the handle 14 is a rounded opening, so that sharp corners are not presented by the rigid member 12. A nonporous wipable case 20 is attached to the upper surface 16 of the rigid member 12 such that it forms an enclosure 22 having an opening 24 at the end thereof nearest the handle 14, as seen in FIGS. 2 and 3. A cushioning pad 26 is received within the enclosure 22 and is removable from the enclosure 22 through the opening 24. The pad 26 is preferably made of a layer of foam material surrounded by a layer of fabric.

As shown in FIGS. 2 and 3, the rigid member 12 has one edge 30 and an opposite edge 32. A first foldable flap member 34 is releasably secured to the one edge 30 of the rigid member 12, and includes a cushioned layer 37 having a first edge 38 and a second edge 39. The flap member 34 is secured to the rigid member 12 by a fastener 36. The fastener 36 may be of any suitable type, e.g., a plurality of snaps, but the preferred form of the fastener 36 is mating Velcro strips running along the one edge 30 of the rigid member 12 and the first edge 38 of the flap member 34. The flap member 34 further includes a cushioned layer 42 attached to the cushioned layer 37 to form pockets in the flap member 34.

A second foldable flap member 50 is releasably secured to the opposite edge 32 of the rigid member 12. The flap member 50 includes a first edge 52, a second edge 54, and a cushioned body 56 therebetween, and is secured to the rigid member 12 by a fastener 58. The fastener 58 may be of any suitable type, e.g., a plurality of snaps, but the preferred form of the fastener 58 is mating Velcro strips running along the opposite edge 32 of the rigid member 12 and the first edge 52 of the flap member 50.

As shown in FIGS. 1 and 2, a pair of straps 60, 62 are attached at first ends thereof to the rigid member 12 in positions on either side of the case 20. The straps 60, 62 are long enough to extend around the case 20 and still remain spaced from the case 20. A fastener 64 allows second ends of the straps 60, 62 to be fastened together.

Figure 4:
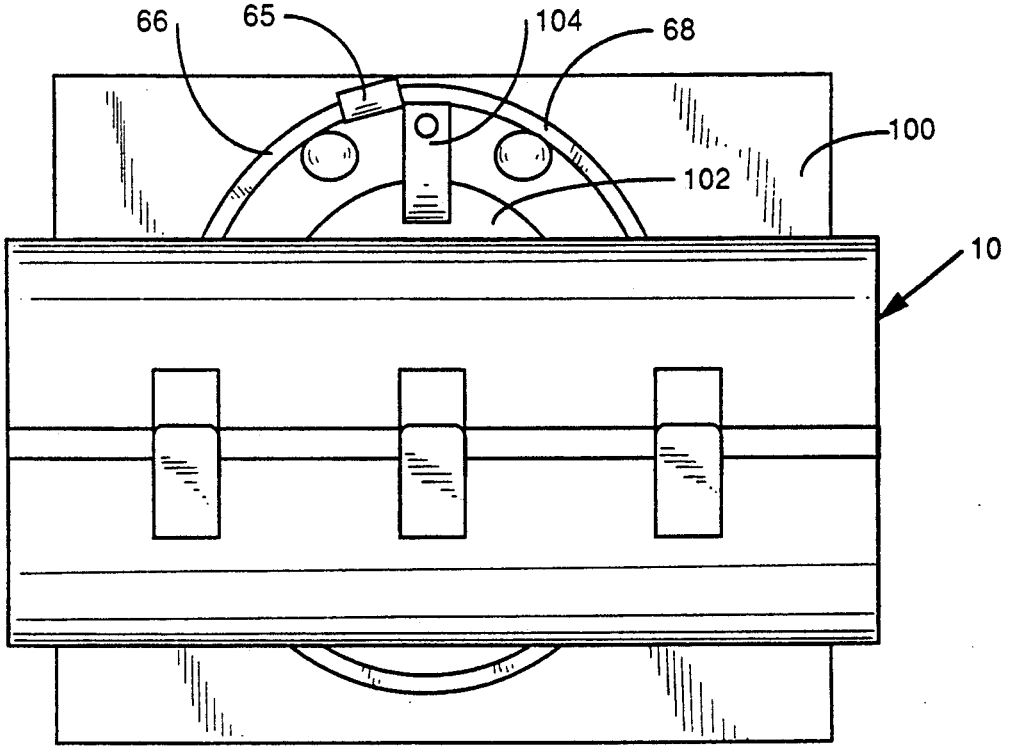
FIG. 4 is a top view of the portable diaper changing station of FIG. 3 releasably secured on a sink.

The fastener 64 may be of any suitable type, e.g., a buckle, but preferably comprises a pair of mating Velcro strips on the second ends of the straps 60, 62. Another pair of straps 66, 68 is also attached at proximal ends thereof to the rigid member 12 at the opposite edge 32 thereof. The straps 66, 68 are spaced apart along the opposite edge 32, as seen in FIG. 4, and each include at their proximal end a mating part 67, 69 of a fastener 65. The fastener 65 allows fastening together of the proximal ends of the straps 66, 68, and may be of any suitable type, although it is preferably a buckle or clasp.

A fastening means 70 is attached to the flap members 34, 50 to allow fastening of the second edges 39, 54 of the flap members 34, 50 together. The fastening means 70 may be of any suitable type, e.g., a zipper or a plurality of snaps or buckles, but preferably consists of a plurality of fasteners each including a pair of mating Velcro strips 72, 74 attached to the second edges 39, 54 of the flap members 34, 50.

With reference to FIGS. 1–5, the structure and operation of the portable diaper changing station 10 will now be explained. The portable diaper changing station 10 is normally maintained in the "closed" position shown in FIG. 3, wherein the flap members 34, 50 are releasably secured by fastening means 70 in positions overlying the case 20. The station 10 can be leant against a wall or cabinet with the rigid member 12 facing the wall or cabinet, and the end of the rigid member 12 having the handle 14 formed therein being uppermost. Accessories for changing a baby's diaper, such as extra diapers, pins, wipes, and powder, will normally be stored in the pockets formed in the first flap member 34.

Figure 5:
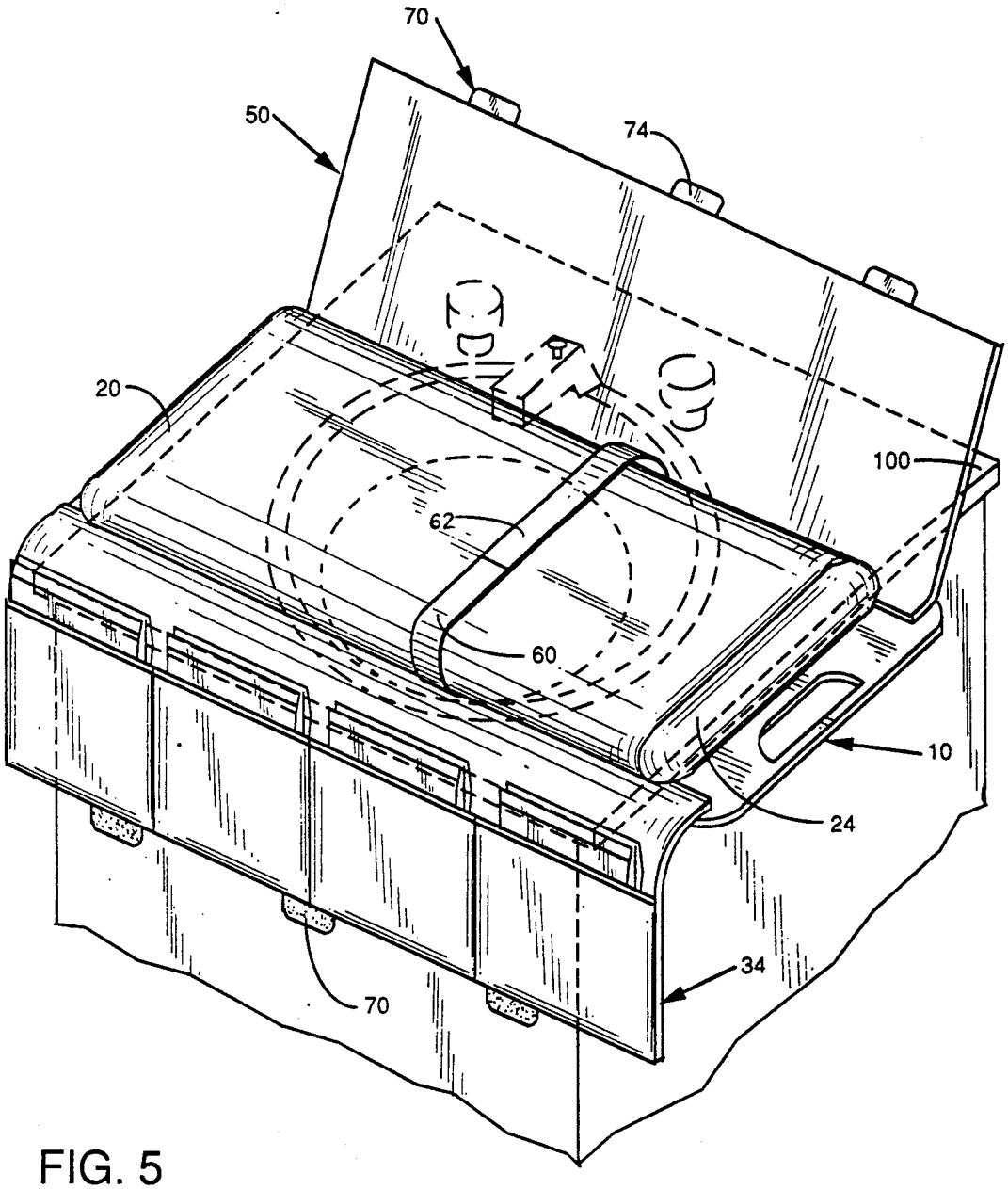
FIG. 5 is a perspective view of FIG. 4 with the flap members extended away from the station.

Although the portable diaper changing station 10 is very useful for changing a baby's diaper on all types of flat surfaces, it is especially useful for changing a baby's diaper on an irregular surface, such as a surface having a cavity formed therein and a protruding portion formed thereon. For example, the station 10 is shown in FIGS. 4 and 5 as used in changing a baby's diaper on a sink 100 having a cavity formed therein in the form of a basin 102 and having a protruding portion formed thereon in the form of a faucet 104.

A method of changing a baby's diaper using the portable diaper changing station 10 on a surface having a cavity formed therein and a protruding portion formed thereon is as follows. The station 10 is first placed on the surface, i.e., sink 100, such that the rigid member 12 overlies the cavity, i.e., basin 102, so that a baby can be supported above the cavity. The straps 66, 68 are then secured around the protruding portion, i.e., faucet 104, by means of fastener 65 to secure the station 10 to the protruding portion. The station 10 is then in the position shown in FIG. 4. The second flap member 50 is extended away from the case 20 such that its cushioned body 56 overlies the protruding portion to protect the baby from accidental contact with the protruding portion, and the first flap member 34 is extended away from the case 20 such that the accessories for changing a baby's diaper which are stored in the pockets of the flap member 34 are accessible. The station is then in the position shown in FIG. 5.

The baby is then placed on the case 20 such that the cushioning pad 26 and the rigid member 12 cushion and support the baby on the surface. For this purpose, the baby can generally weigh up to 30–35 pounds for a rigid member 12 which is preferably made of a hard pressboard. For babies which weigh more than 30–35 pounds, a sturdier construction would be desirable. The baby may be releasably secured to the station 10 by means of the straps 60, 62, which can be extended around the case 20 and the baby's chest and fastened together by means of the fastener 64. The baby's diaper can then be changed using the accessories stored in the pocket of the flap member 34, and the baby can be released from the straps 60, 62 and removed from the station 10. The flap members 34, 50 are folded into positions overlying the case 20 and fastened together by means of the fastening means 70, the straps 60, 62 are unfastened, and the station 10 is removed from the surface.

If a baby soils a portion of the portable diaper changing station 10 during a changing operation, that portion can be easily cleaned. For example, since the flap members 34, 50 are releasably secured to the rigid member 12 by fasteners 36, 58, they can easily be removed from the rigid member 12 and washed as needed. Since the case 20 is made of a nonporous wipable material such as a plastic, it may easily be wiped clean. If by some chance the cushioning pad 26 becomes soiled, it can be removed from the enclosure 22 through the opening 24 and cleaned.

The advantages of the portable changing station 10 can be readily seen. Since the station 10 is lightweight and is designed to carry necessary diaper changing accessories, the station 10 can be carried anywhere and will enable changing of a baby's diaper almost any place. The station 10 is also useful simply as a second changing table in a two-story house, since it can be stored out of the way downstairs and used as convenient downstairs changing table without requiring installation of a second permanent changing table. Since the station 10 includes rigid member 12, cushioning pad 26, and flap member 50, inter alia, it allows safe changing of a baby's diaper on a large number of irregular surfaces. Due to the inclusion of straps 66, 68 to releasably secure the station 10 to a protruding portion of the surface, and also the inclusion of straps 60, 62 to releasably secure the baby to the station 10, changing can be carried out relatively safely because harm to the baby from falling is minimized.

It is to be understood that, while not shown in the drawings, it is within the scope of the invention to include shoulder straps attached to the rigid member 12, which shoulder straps are attached to or are fastenable to the straps 60, 62 to more effectively secure larger-size babies to the station 10. Also, it is within the scope of the invention to attach the straps 60, 62 to the rigid member 12 by means of a first pair of snaps or other fasteners. Another pair of snaps or fasteners can be located on the rigid member 12 further from the handle 14, such that the straps 60, 62 can be moved to strap across a baby's chest whose head is located opposite the handle. Such a feature would make the station easier to use for both left- and right- handed parents.

It is further within the scope of the invention for the cushioned layer 41 to be formed as a set of separate layer pieces which are fastened, i.e., by Velcro, to the cushioned layer 37 to allow the parent to organize the pockets as he or she sees fit. It is further within the scope of the invention for the nonporous wipable case 20 to be fastened to the rigid member 12 such that it is changeable. To this end, different cases having different designs thereon could be made available to allow parents to match the decor of a particular room. A non-slip or rubberized backing 80 on the rigid member 12, to reduce slipping thereof and to prevent marring of the surface on which the station rests, is also within the scope of the invention, as seen in FIG. 3.

The principles, a preferred embodiment and the mode of operation of the present invention have been described in the foregoing specification. However, the invention which is intended to be protected is not to be construed as limited to the particular embodiment disclosed. The embodiment is therefore to be regarded as illustrative rather than restrictive. Variations and changes may be made by others without departing from the spirit of the present invention. Accordingly, it is expressly intended that all such equivalents, variations and changes which fall within the spirit and scope of the present invention as defined in the claims be embraced thereby.

What is claimed is:

1. A portable diaper changing station for enabling changing of a baby's diaper on a surface having a protruding portion, said station comprising:

a nonbendable rigid member having a handle portion formed therein and having an upper surface;

a cushioning pad;

a nonporous wipable case attached to said upper surface, said case defining an enclosure having at least one opening for receiving said cushioning pad within said enclosure;

a first foldable flap member releasably secured to one edge of said rigid member, said first flap member having pockets formed therein;

a second, foldable cushioned flap member releasably secured to an opposite edge of said rigid member for cushioning the protruding portion of the surface; and connecting means attached to said rigid member for releasably connecting said rigid member to the protruding portion of the surface.

2. A portable diaper changing station as claimed in claim 1, wherein said first flap member is releasably secured to said one edge of said rigid member by a first fastener, a first part of said first fastener being attached to said first flap member and a second part of said first fastener being attached to said one edge.

3. A portable diaper changing station as claimed in claim 1, wherein said second flap member is releasably secured to said opposite edge of said rigid member by a second fastener, a first part of said second fastener being attached to said second flap member and a second part of said second fastener being attached to said opposite edge.

4. A portable diaper changing station as claimed in claim 1, wherein said first and second flap members each include a first and a second edge, and wherein said flap members are releasably secured to said rigid member at said respective first edges, said station further including fastening means for fastening said second edges together when said flap members are folded into positions overlying said case.

5. A portable diaper changing station as claimed in claim 4, wherein said fastening means includes a plurality of two-piece fasteners, one piece of each fastener attached to said second edge of said first flap member and a mating piece of each fastener attached to said second edge of said second flap member.

6. A portable diaper changing station as claimed in claim 1, further including means for releasably securing a baby to said station.

7. A portable diaper changing station as claimed in claim 6, wherein said releasable securing means includes one strap attached to said one edge of said rigid member, a second strap attached to said opposite edge of said rigid member, and fastening means for fastening said straps together in positions overlying said case.

8. A portable diaper changing station as claimed in claim 1, wherein said connecting means includes a pair of straps attached to said opposite edge of said rigid member, and means for fastening said straps together around the protruding portion of the surface.

9. A portable diaper changing station as claimed in claim 1, wherein said cushioning pad is removable from said enclosure through said opening, to allow cleaning of said pad.

10. A portable diaper changing station as claimed in claim 1, wherein said rigid member has a lower surface having means thereon for preventing slipping of said rigid member on the surface.

11. A method of changing a baby's diaper using a portable changing station mounted on a surface having a cavity formed therein and a protruding portion formed thereon, said method comprising the steps of:

placing said portable baby diaper changing station on said surface such that a baby support means of said station overlies said cavity to support a baby above said cavity, said support means including a cushion overlying a rigid nonbendable member;

securing a releasable securing strap which is attached to said rigid member around said protruding portion to secure said portable baby diaper changing station to said protruding portion;

extending a foldable cushioning means which is releasably secured to said support means over said protruding portion to protect the baby from accidental contact with said protruding portion;

extending a foldable accessory holding means which is releasably secured to said support means away from said support means such that accessories for changing a baby's diaper which are held in the holding means are accessible;

placing the baby on said support means such that said support means supports and cushions the baby on said surface;

changing the baby's diaper; and removing the baby from said support means.

12. A method as claimed in claim 11, further including the steps of releasing said cushioning means from said support means, cleaning said cushioning means, and resecuring said cushioning means to said support means.

13. A method as claimed in claim 11, further including the steps of releasing said accessory holding means from said support means, cleaning said accessory holding means, and resecuring said accessory holding means to said support means.

14. A method as claimed in claim 11, wherein said support means further includes a nonporous wipable case attached to said rigid member and enclosing said cushion, and wherein said method further includes the step of wiping said case clean after said baby removing step.

15. A method as claimed in claim 14, further including the steps of removing said cushion from said case, cleaning said cushion, and replacing said cushion in said case.

16. A method as claimed in claim 11, further including the step of releasably securing the baby to said support means during said diaper changing step.

17. A method as claimed in claim 11, further including the steps of folding said cushioning means and said accessory holding means into positions overlying said support means, fastening said cushioning means to said accessory holding means, and removing said station from the surface.

18. A portable diaper changing station for enabling changing of a baby's diaper on a sink having a basin and a faucet, said station comprising:

a rectangular nonbendable rigid member having a handle portion formed therein and having an upper surface, said rigid member adapted to overlie said basin and support a baby thereover;

a rectangular cushioning pad, said cushioning pad including a layer of foam surrounded by a layer of fabric;

a nonporous wipable case attached to said upper surface, said case defining an enclosure having at least one opening for receiving said cushioning pad within said enclosure;

a first foldable flap member releasably secured to one edge of said rigid member by a first fastening means, said first flap member having a first edge, a second edge, and pockets formed therein for receiving accessories for changing the baby's diaper, said first fastening means including a first part attached to said one edge of said rigid member and a second part attached to said first edge of said first flap member;

a second foldable flap member releasably secured to an opposite edge of said rigid member by a second fastening means, said second flap member having a first edge, a second edge, and a cushioned body for cushioning the baby against accidental contact with the faucet of the sink, said second fastening means including a first part attached to said opposite edge of said rigid member and a second part attached to said first edge of said second flap member;

a first pair of straps, each of said first pair of straps having a first end and a second end, said first ends of first pair of straps being attached to said rigid member, and said second ends of said first pair of straps being fastenable together in positions overlying said case to releasably secure the baby to said station;

a second pair of straps, each of said second pair of straps having a proximal end and a distal end, said proximal ends of said second pair of straps being attached to said opposite edge of said rigid member;

a third fastening means including two fastening parts, each of said fastening parts being attached to one of said distal ends for releasably securing said distal ends together to allow releasable securing of said station to the faucet; and a fourth fastening means including a plurality of fourth fasteners each having a pair of fastening parts, said fastening parts of said fourth fasteners being attached to said second edges of said first and second flap members to allow fastening of said first and second flap members together in positions overlying said case.

* * * * *

UNITED STATES PATENT AND TRADEMARK OFFICE

CERTIFICATE OF CORRECTION

PATENT NO. : 5,299,336
DATED : April 5, 1994
INVENTOR(S) : Jean Marteeny

It is certified that error appears in the above-identified patent and that said Letters Patent is hereby corrected as shown below:

On the title page, item [56]:

In References Cited, add the following:

| | | |
|---|---|---|
| --2,626,407 | 1/1953 | Kurry |
| 3,659,297 | 5/1972 | Schutz |
| 4,750,401 | 6/1988 | Markey |
| 4,863,003 | 9/1989 | Carter |
| 5,103,514 | 4/1992 | Leach |

In Other Documents

Baby Bjorn, Tested Swedish Baby Products Superb Design and Guaranteed for Two Years--.

Signed and Sealed this

Twentieth Day of September, 1994

*Attest:*

Bruce Lehman

BRUCE LEHMAN

*Attesting Officer*

*Commissioner of Patents and Trademarks*